US005713720A

United States Patent [19]

Barhoum

[11] Patent Number: 5,713,720

[45] Date of Patent: Feb. 3, 1998

[54] TURBO-MACHINE WITH A BALANCE PISTON

[75] Inventor: Mohamed Barhoum, Ludwigshafen, Germany

[73] Assignee: SIHI Industry Consult GmbH, Itzehoe, Germany

[21] Appl. No.: 704,599

[22] PCT Filed: Jan. 17, 1996

[86] PCT No.: PCT/EP96/00185

§ 371 Date: Sep. 17, 1996

§ 102(e) Date: Sep. 17, 1996

[87] PCT Pub. No.: WO96/22468

PCT Pub. Date: Jul. 25, 1996

[30] Foreign Application Priority Data

Jan. 18, 1995 [DE] Germany ..... 295 00 744 U

[51] Int. Cl.[6] ..... F01D 3/00

[52] U.S. Cl. ..... 415/104; 415/107

[58] Field of Search ..... 415/104, 107

[56] References Cited

U.S. PATENT DOCUMENTS

| | | | |
|---|---|---|---|
| 2,221,225 | 11/1940 | Wels et al. . | |
| 4,892,459 | 1/1990 | Guelich | 415/107 |
| 5,104,284 | 4/1992 | Hustak, Jr. et al. | 415/104 |
| 5,312,225 | 5/1994 | Lorenzen | 415/107 |
| 5,531,564 | 7/1996 | Anttonen et al. | 415/104 |
| 5,540,546 | 7/1996 | Bouricet | 415/104 |

FOREIGN PATENT DOCUMENTS 1 453 787 5/1969 Germany .

*Primary Examiner*—John T. Kwon
*Attorney, Agent, or Firm*—Alix, Yale & Ristas, LLP

[57] ABSTRACT

Fluid-flow machine having shaft (1) which is mounted in an axially fixed fashion, and a balancing piston (6) firmly arranged thereon. In order to reduce the leakage flow, the balancing piston (6) is partially replaced by a porting ring (12) which forms with the balancing piston a choke gap (11), through which radial flow occurs, and a cylindrical upstream throttle (13) through which axial flow occurs.

2 Claims, 1 Drawing Sheet

TURBO-MACHINE WITH A BALANCE PISTON

BACKGROUND OF THE INVENTION

During the operation of fluid-flow machines, reaction forces are transmitted onto the shaft which have, in turn, to be transmitted from the latter onto the fixed housing. Since it is undesirable to direct these forces exclusively via the shaft bearing, various compensating and balancing devices have been developed. In a known compensating device (Pfleiderer: Die Kreiselpumpen (Centrifugal Pumps), 1949, pages 366–368), the entire axial force is transmitted via a pressure plate, connected in a rotationally fixed fashion to the shaft, onto an end face of the housing which, together with the pressure plate, encloses a choke gap through which radial flow occurs. A low pressure is applied to it on its rear side, and a higher, choked-off pressure of the machine is applied to it on the choke-gap side. In operation, a choke gap is set up which depends on the difference between these pressures and permits contactless force transmission in the case of constant through flow and constant operating conditions. The shaft must be axially movable so that the choke gap can be set up in accordance with the pressure difference. For reasons of operational reliability, this is impossible in many cases in which, therefore, the application of a compensating plate is prohibited. Recourse is made in these cases to a so-called balancing piston. This is a ring which is firmly arranged on the shaft and rotates with as little play as possible in the bore of a fixed housing part and to which a higher fluid pressure is applied on one side than on the other. The force thereby resulting on the balancing piston serves to balance a bearing which determines the axial position of the shaft. With regard to operational reliability, the axial gap between the circumference of the balancing piston and the bore of the housing cannot drop below a certain minimum. The result is a high leakage which can amount to 4–6% of the flow rate and can therefore substantially impair the overall efficiency.

This high leakage can be prevented by providing the balancing piston with a ring which can rotate freely with respect to said piston and instead of the balancing piston is sealed with respect to the housing, and does not rotate with respect to the housing but can move axially together with the balancing piston (U.S. Pat. No. 2,221,225). This ring is seated in a circumferential groove of the balancing piston, its end faces enclosing two narrow gaps with the sides of the groove, which are parallel to said piston. During operation, the ring is to occupy an approximately central position between the groove sides. The leakage flow is then determined by the width of the two end-face gaps. The distance to the groove bottom has no effect, since it is very large. Contact between the ring and the balancing piston is normally not to occur during operation. This known arrangement has the disadvantage that the size of the leakage flow and the dynamic behaviour of the ring depend on the play between the end faces of the ring and the groove sides, and thus on the manufacturing tolerances and wear. It also tends to unstable behaviour.

SUMMARY OF THE INVENTION

It is therefore the object of the invention to provide a balancing arrangement of the last-mentioned type which is of simple design and does not tend to instability in operational performance.

The solution according to the invention resides in providing a balancing piston that is arranged firmly on an axially fixed shaft for rotation with radial play. A porting ring which can move axially between the balancing piston and a housing bore is sealed with respect to the housing bore. An end face of the porting ring and a radial annular projection of the balancing portion form a radial choke through which radial flow occurs. The porting ring and the circumference of the balancing piston also define an annular gap forming an upstream throttle. The outside diameter of the radial choke gap is larger than the diameter of the circumference of the porting ring that cooperates with the housing bore.

The balancing arrangement according to the invention requires only a radial annular gap between the balancing piston and the porting ring. Connected ahead of said porting ring is an upstream throttle in the form of a narrow, cylindrical annular gap between these two parts. Since the throttling action of this annular gap is independent of the axial position of the porting ring, a very stable operational performance results. There is no need for precise manufacture.

With regard to the throttling of the leakage flow, the arrangement according to the invention is the same as a choke gap seal through which radial flow occurs (Müller: Abdichtung bewegter Maschinenteile (Sealing of moving machine parts), Waiblingen 1990, pages 141 to 144). This is a type of seal which is similar to the axial seal but, for the purpose of reliably avoiding solid-body contact between the sliding surfaces, encloses a permanently open gap which does not produce a seal but only throttles a leakage flow. The special effect of the arrangement according to the invention by comparison with the known axial seal consists in that the porting ring participates in the application of the balancing force. Its entire cross-section located inside the housing bore is subjected to the pressure difference forming the balancing force. The force component thereby acting on it is transmitted away via the choke gap onto the annular projection of the balancing piston and therefore benefits the balancing effect, although the porting ring is not firmly connected to the shaft.

An axial thrust compensating device has been disclosed (DE-A 14 53 787) which provides for a shaft which is mounted in an axially movable fashion two radial choke gaps, of which one cooperates with a mating face fixed in the housing, while the other cooperates with a ring which is connected in a rotationally fixed fashion to the housing, but which is axially movable and sealed with respect to the housing. The cylindrical annular gap between the said three components acts as a throttle. This design cannot be used for balancing arrangements on a shaft which is mounted in an axially fixed fashion. Moreover, it is very expensive.

The outside diameter of the end face, participating in the formation of the radial choke gap, of the porting ring is preferably larger than the diameter of the circumference, cooperating with the housing bore, of the porting ring. This is effected by means of an annular projection or flange which is provided on the porting ring and is subjected on the side of the choke gap to the possibly higher gap pressure influenced from the pressure side, and on its rear side to the low pressure. As a result, the size of the choke gap can be reliably set up for given operating conditions.

BRIEF DESCRIPTION OF THE DRAWING

The invention is explained below in more detail with reference to the drawing, in which.

DESCRIPTION OF A PREFERRED EMBODIMENT

Figure 1:
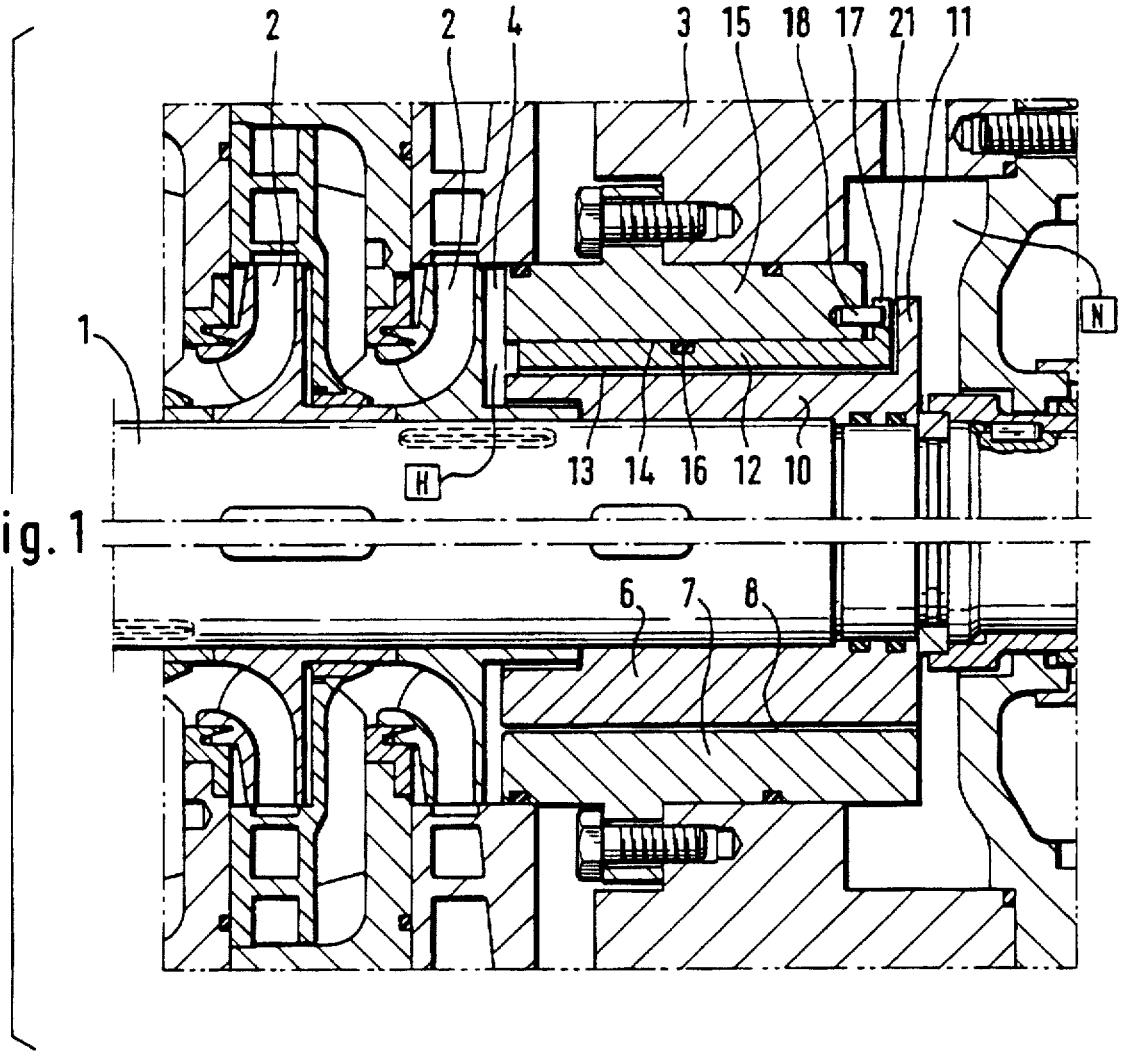
FIG. 1 shows a section through that part of a multi-stage centrifugal pump which contains the balancing piston; the representation in the lower half shows the arrangement of the balancing piston according to the prior art, while the other half shows the design according to the invention.

The shaft 1, which bears the rotary impellers of the pump stages 2, is mounted in an axially fixed fashion (in a way not shown) in the housing, of which a part can be seen at 3. The balancing piston device is provided between a space 4 of the pump to which high pressure "H" is applied, and a space 5 in which lower pressure "N" prevails. In the known arrangement, said balancing piston device is formed by the balancing piston 6 and the fixed housing part 7, which cooperate via a cylindrical choke gap 8. The balancing piston 6 is arranged fixed on the shaft 1. Its cross-sectional area is dimensioned such that the differential pressure acting thereon produces the desired balancing force. The annular gap 8 generally has a width of a few tenths of a millimeter and, for the purpose of reducing the leakage flow, a substantial axial length.

In the arrangement according to the invention (upper half of the drawing), the balancing piston 10 has a smaller diameter. It is provided at the low-pressure end with a flange-type, radial annular projection 11.

The balancing piston 10 surrounds the porting ring 12, which is constructed in a hollow cylindrical fashion and encloses with the cylindrical circumferential surface of the balancing piston 10 an annular gap 13 which has a radial width of a few tenths of a millimeter. Its cylindrical circumferential surface is guided in the cylindrical bore 14 of the fixed housing part 15, the play being dimensioned such that it can move freely axially under all operating conditions. It is expedient to provide a sealing ring 16 on this side of the porting ring. Said sealing ring can be dispensable if the play between the porting ring and housing bore is so slight that the leakage flow thereby occurring is negligible. At the low-pressure end, the porting ring 12 bears an annular projection 17 which is pinned at 18 to the fixed housing part 15 in a fashion Which is axially movable but rotationally fixed.

The end face, facing the high-pressure side, of the annular projection 11 of the balancing piston 10, on the one hand, and the end face, on the low-pressure side, of the annular projection 17 of the porting ring 12 enclose the choke gap 21 through which radial flow occurs. They do not have to extend precisely radially, but have a substantial radial component. They are essentially parallel to one another. Deviations from parallelism can be caused, for example, by a wedge shape which narrows in the direction of flow (see Schneider loc. cit).

Figure 2:
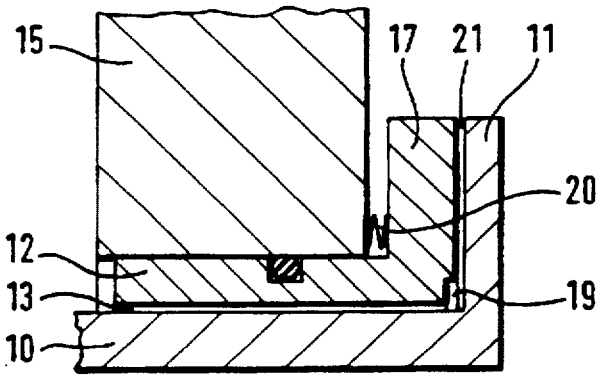
FIG. 2 shows a partial section through the balancing piston and the associated housing part.

The choke gap does not need to extend over the entire radial expanse of the said end faces; however, the distance from the end face can be larger in the radially inner region, as is shown in FIG. 2 at 19. The actual choke gap then starts a little further out radially, it being possible for the transition to be made either in a stepwise fashion (as in FIG. 2) or gradually. A spring 20, which urges the radial throttle end faces towards one another, is not excluded, but is generally not required. It is even possible to provide a spring which urges the throttle end faces apart from one another in order to prevent solid-body contact during starting of the machine.

The throttling action in the annular gap 13 contributes to stabilizing the radial choke gap. The throttling action in the annular gap 13 is expediently between 10 and 50% of the total differential pressure.

Since the throttling action in the annular gap 13 is only of secondary importance for restricting the flow, the designer has extensive freedom in dimensioning the gap width. He can therefore give it a more generous dimension at this point than in the prior art, and this can be of great importance, in particular in thermally operating machines, whose parts can be subjected to thermal expansions which differ in operation.

Thanks to the invention, the leakage flow in the region of the balancing piston can be reduced to less than half of the amount previously customary. The overall efficiency can thereby be raised by several points.

Although in the case of the representation shown at the top in FIG. 1 the balancing piston 10 has a smaller outside diameter than in that represented at the bottom and belonging to the prior art, the compensating effect is the same if the outside diameter of the porting ring 12 is equal to the outside diameter of the known balancing piston 6. The reason for this is that the differential force acting on the porting ring 12 is also transmitted onto the balancing piston 10 via the annular projections 11 and 17 and the choke gap 21.

I claim:

1. A fluid-flow machine having a housing bore (14), a shaft (1) mounted in an axially fixed fashion, a balancing piston (10) arranged firmly on the shaft for rotation with radial play in the housing bore (14), and a porting ring (12) movable axially between the balancing piston (10) and the housing bore (14) and sealed with respect to the housing bore (14), the balancing piston (10) having a radial annular projection (11), the porting ring having an end face that cooperates with the radial annular projection to form a radial choke gap (21) through which radial flow occurs, the porting ring (12) defining with the circumference of the balancing piston (10) an annular gap (13) forming an upstream throttle.

2. Fluid-flow machine according to claim 1, characterized in that the outside diameter of the radial choke gap (21) is larger than the diameter of the circumference, cooperating with the housing bore (14), of the porting ring (12).

* * * * *